United States Patent [19]

Dawn

[11] Patent Number: 4,630,759

[45] Date of Patent: Dec. 23, 1986

[54] VESSEL WITH PUMP SUCTION TUBE SUPPORT

[76] Inventor: Ronald C. Dawn, 9517 Harrison Bay Rd., Harrison, Tenn. 37341

[21] Appl. No.: 791,055

[22] Filed: Oct. 24, 1985

[51] Int. Cl.[4] ..... B67D 5/40

[52] U.S. Cl. ..... 222/377; 222/382; 222/376; 222/372; 222/383; 222/464

[58] Field of Search ..... 222/382, 416, 464, 383, 222/377, 372, 376, 381

[56] References Cited

U.S. PATENT DOCUMENTS

| | | | |
|---|---|---|---|
| 646,527 | 4/1900 | Linton | 222/464 X |
| 729,145 | 5/1903 | Eckenwiler | 222/464 |
| 850,070 | 4/1907 | Spikes | 222/464 X |
| 1,977,360 | 10/1934 | Talbot | 222/382 |
| 2,154,479 | 4/1939 | Spayd | 222/464 X |
| 2,344,005 | 3/1944 | Sundholm | 222/382 |
| 2,539,349 | 1/1951 | Giles | 222/464 X |
| 3,250,440 | 5/1966 | Trout | 222/382 X |

*Primary Examiner*—H. Grant Skaggs
*Assistant Examiner*—Jay I. Alexander
*Attorney, Agent, or Firm*—Alan Ruderman

[57] ABSTRACT

A pump suction tube support is mounted at the bottom of a fluid vessel such as a barrel for supporting the tube and providing stability to the pump which is mounted on the top of the barrel. The support includes a hollow cylindrical support member for receiving the suction tube and an enlarged base secured to the bottom wall of the vessel. The lower end of the support member has a series of spaced apart feet secured to the base member and the spaces between the feet provide communication for the fluid to flow into the bottom of the support member. The support member may include a diametrically extending slot for receiving a pin in the tube to prevent rotation of the tube.

6 Claims, 3 Drawing Figures

VESSEL WITH PUMP SUCTION TUBE SUPPORT

BACKGROUND OF THE INVENTION

This invention relates to closed top fluid containing vessels to which pumps are attached for emptying the vessel, the vessel having a support member at the bottom for supporting the pump.

In the handling of fluids such as hydraulic oil, diesel fuel, anti freeze and the like, closed top barrels are used extensively. These barrels, such as the conventional 55 gallon drums, have a small aperture at the top of the barrel for receiving the suction tube of conventional pumps. Generally, these pumps are manually operable and are of the cranking handle type requiring a to and fro motion by the operator or of the revolving handle type having an operator rotatable handle. The aperture in the top of the barrel is formed with a threaded collar for cooperating with threads associated with the pump. Both type pumps have a suction tube extending from the suction inlet of the pump. In the cranking handle type pump a threaded sleeve is fixed to the upper end of the suction tube or the pump proper and the sleeve is threaded into the collar of the barrel. In the rotating handle type pump a slidable sleeve or nut on the suction tube is threaded into the collar and a set screw secures the sleeve to the tube. The lower end of the suction tubes are not supported in any manner. Thus, the back and forth action of the cranking handle pump place forces on the collar which after some time results in the collar breaking out from the top of the barrel. In the case of the revolving handle pump the set screw works loose after some use causing the suction tube to rotate, thereby resulting in mashing of the knuckles of the operator against the top or edge of the barrel.

SUMMARY OF THE INVENTION

Consequently, it is a primary object of the present invention to provide within a closed top barrel a support for the suction tube of pumps so as to avoid the breaking of the threaded collar in the top wall of the barrel when used with cranking handle manual pumps and to preclude rotation of the suction tube when used with revolving handle pumps.

It is another object of the present invention to provide a cylindrical support at the bottom of fluid vessels for supporting the end of hand pump suction tubes, the support having a base attachable to the bottom of the vessel and means for permitting fluid to enter the suction tube from between the support and the base.

Accordingly, the present invention provides a suction tube support member at the bottom of a fluid vessel such as a barrel, the support member having a hollow cylindrical configuration for receiving the suction tube of a pump and mounted on an enlarged base which may be welded or otherwise fastened to the bottom of the vessel without unduly stressing the vessel bottom, the cylindrical support member being attached to the base while maintaining communication therebetween so that fluid may be pumped over the base and up the support into the suction tube. The upper end of the support member may have diametrically opposed slots for receiving a pin attached to the suction tube to preclude the latter from rotating relative to the support. Preferably, the lower end of the support member has a number of spaced apart feet secured to the base, the space between the feet being disposed above the base so as to provide a communication to the interior of the support and thus the suction tube of the pump. The lower surface of the base may be contoured to abut and be secured to the bottom of any shaped fluid containing vessel.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
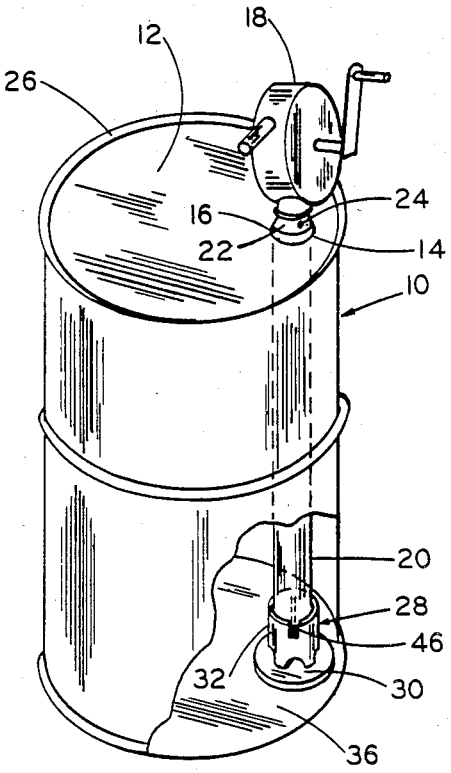
FIG. 1 is a perspective view of a barrel partly broken away to illustrate a pump suction tube support constructed in accordance with the principles of the present invention, a manual revolving handle type pump being mounted on the upper end of the barrel.
Figure 2:
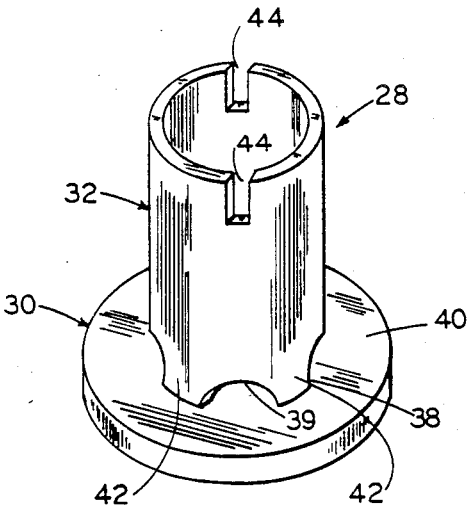
FIG. 2 is a top perspective view of the pump support illustrated in FIG. 1 dissassembled from the barrel.
Figure 3:
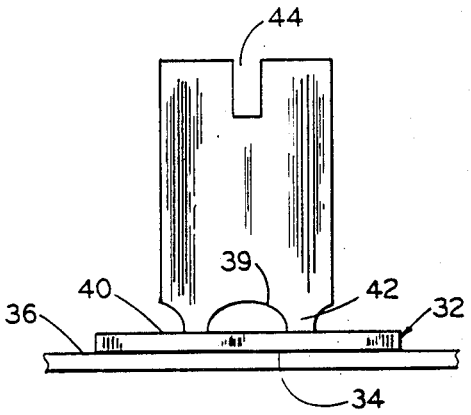
FIG. 3 is an elevational view of the pump support as mounted on a fragmentary portion of the bottom of a vessel.

Referring now to the drawings, a typical barrel or drum 10 is illustrated having a closed top 12 and a small aperture 14 in the top through which stored fluid may be removed. The aperture receives a collar 16 having internal threads (not illustrated), the collar being welded or otherwise bonded within the aperture to the top 12. A revolving handle pump 18 is one type pump utilized in practice for providing the the pressure head required for removing fluid from the barrel. The suction side of the pump 18 is attached to and communicates with a suction tube 20 which conventionally extends into the barrel and is unsupported at its lower end. Conventionally, revolving handle type pumps have a slidable externally threaded sleeve 22 disposed about the tube 20 and threaded into the collar 16. A set screw 24 threaded into the sleeve secures the tube 20 to the collar 16. In time the set screw tends to work loose resulting in the tube 20 rotating. This has caused the knuckles of many a workman to be mashed against the lip 26 of the barrel 10 as the pump rotates with the tube before the workmen realizes what has happened. When a to and fro type crank handle pump is used on the barrel, the back and forth action of the crank handle in time results in fatigue of the weld between the collar 16 and the barrel top 12.

To solve these problems the present invention provides a pump support generally indicated at 28 comprising a base member 30 on which a support member 32 is disposed. Preferably the members 30 and 32 are steel so that the support member 32 may be welded to the base 30. The base member 30 for use with a barrel of the 55 gallon drum type should have a planar lower face 34 so that it may abut the inner bottom wall 36 of the barrel flush, but for vessels of other shapes the lower surface of the base should be contoured to the specific shape of the bottom wall of the vessel.

The support member 32 has a hollow cylindrical configuration of a diameter slightly larger than that of the suction tube 20 and is disposed directly below the aperture 14 and aligned therewith. The height of the member 32 need only extend above the base an amount sufficient to receive the bottom end of the suction tube 20. The bottom edges 38 of the member 32 are attached to the upper face 40 of the base in a manner permitting the fluid to enter the interior of the member 32. As illustrated in the preferred embodiment the member 32 has a number of spaced apart feet 42 which are secured to the face 40, the surface of the member 32 between the feet being disposed above the surface 40 by contouring the bottom edge 38 of the member 32 in an arcuate or arch configuration between the leading edges of one foot and the trailing edge of the adjacent foot such as at 39. Thus, fluid may communicate through the arch and into the hollow of the cylindrical member 32.

The size of the base 30 has substantially a larger section when viewed in plan than that of the member 32 so that the bottom of the base may be welded or the like to the bottom wall 36 of the barrel or other vessel without placing undo stress on the bond. If the member 32 itself were attached to the barrel the small area of attachment due to the size of the feet would result in a large stress at the weld or other bond between the feet and the vessel, and since such vessels have relatively thin walls, the weld would not be strong and probably would soon overstress. The exact size of the base is not critical but it should be large enough to result in a reasonable loading between the base and the vessel bottom.

The upper end of the member 32, at least for the revolving handle type pumps, should preferably have a diametrically extending slot 44 disposed therethrough, the width and length of the slot being sufficient to receive a pin 46 inserted through the suction tube adjacent the lower end thereof. Thus, not only may the suction tube be disposed within the hollow of the member 32, but the pin 46 will preclude rotational turning of the tube 20. For crank type pumps the pin would not be required since the member 32 would restrain the tendency of the tube 20 to move as the handle is cranked and thus prevent overstressing of the collar 16, thereby eliminating the tendency of the collar from breaking out of the barrel.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. The combination of fluid storage vessel having a bottom wall, a top wall and an aperture in the top wall for receiving a pump suction tube having a circular cross section through which fluid may be pumped out of the vessel, and a suction tube support for supporting the lower end of the suction tube, said suction tube support comprising a base member fastened to said bottom wall, tube support member secured to and extending upwardly from said base member, said support member comprising a hollow cylindrical body aligned with the aperture for receiving said tube, the bottom of said support member having wall means spaced above said base for permitting fluid to flow over the base member and into the interior of the support member for communication with the suction tube, the upper end of said support member including a slot extending diametrically therethrough, and said tube includes a pin receivable within said slot for precluding rotation of said tube when positioned in said support member.

2. The combination as recited in claim 1, wherein said base has a substantially larger cross sectional configuration than said support member.

3. The combination as recited in claim 2, wherein said wall means comprises spaced feet secured to said base, the space between adjacent feet opening into the interior of said support member.

4. The combination as recited in claim 3, wherein the configuration of said wall means between adjacent feet is arcuate.

5. The combination as recited in claim 1, wherein said wall means comprises spaced feet secured to said base, the space between adjacent feet opening into the interior of said support member.

6. The combination as recited in claim 5, wherein the configuration of said wall means between adjacent feet is arcuate.

* * * * *

UNITED STATES PATENT AND TRADEMARK OFFICE

CERTIFICATE OF CORRECTION

PATENT NO. : 4,630,759

DATED : December 23, 1986

INVENTOR(S) : Ronald C. Dawn

It is certified that error appears in the above-identified patent and that said Letters Patent is hereby corrected as shown below:

Column 4, line 13, after "wall," please insert -- a --

Signed and Sealed this

Twenty-fourth Day of March, 1987

*Attest:*

DONALD J. QUIGG

*Attesting Officer*

*Commissioner of Patents and Trademarks*